US006029551A

United States Patent [19]

Wu

[11] Patent Number: 6,029,551

[45] Date of Patent: Feb. 29, 2000

[54] SCREWDRIVER HAVING MEANS FOR ADJUSTING MAGNETICALLY TORSIONAL MOMENT OF THE SCREWDRIVER

[76] Inventor: Chin-Long Wu, No. 136-12, Young Ho Road, Ta-Ya Hsiang, Taichung Hsien, Taiwan

[21] Appl. No.: 09/083,543

[22] Filed: May 22, 1998

[51] Int. Cl.[7] ..... B25B 23/157

[52] U.S. Cl. ..... 81/475; 81/429; 81/467

[58] Field of Search ..... 81/429, 440, 436, 81/449, 467, 468, 473, 474, 480, 475, 476; 173/170, 171

[56] References Cited

U.S. PATENT DOCUMENTS

| | | | |
|---|---|---|---|
| 1,769,510 | 7/1930 | Herman | 81/475 |
| 1,832,123 | 11/1931 | Holland | 81/475 |
| 2,410,971 | 11/1946 | Hartley | 81/475 |
| 2,536,225 | 1/1951 | Rice | 81/475 |
| 2,576,069 | 11/1951 | Hoag et al. | 81/475 |
| 2,764,882 | 10/1956 | Bosworth | 81/475 |
| 2,777,346 | 1/1957 | Brame | 81/476 |
| 2,797,564 | 7/1957 | Bonneau et al. | 81/475 |
| 3,012,456 | 12/1961 | Dracka | 81/475 |
| 3,292,678 | 12/1966 | Noga | 81/475 |
| 3,783,716 | 1/1974 | Saito | 81/52.4 R |
| 4,517,865 | 5/1985 | Huang | 81/475 |
| 4,653,359 | 3/1987 | Liao | 81/475 |

*Primary Examiner*—James G. Smith
*Assistant Examiner*—David B. Thomas
*Attorney, Agent, or Firm*—Browdy and Neimark

[57] ABSTRACT

A screwdriver is composed of a handle, a magnetic member, a shank, and an adjusting device. The handle is provided with an axial hole in which the magnetic member is disposed. The shank is pivotally disposed in the axial hole such that the shank is fastened at one end thereof with a blade, and that another end of the shank is capable of a mutual attraction with the magnetic member. The magnitude of the mutual attraction is adjusted by the adjusting device to determine a pre-set desired torsional moment. The handle and the shank are capable of turning relative to each other at the time when a torsional moment exerting on the screwdriver is greater than the pre-set desired torsional moment.

20 Claims, 10 Drawing Sheets

SCREWDRIVER HAVING MEANS FOR ADJUSTING MAGNETICALLY TORSIONAL MOMENT OF THE SCREWDRIVER

FIELD OF THE INVENTION

The present invention relates generally to a screwdriver, and more particularly to a screwdriver provided with a magnetic device for adjusting the torsional moment of the screwdriver.

BACKGROUND OF THE INVENTION

The conventional screwdriver is not entirely effective in design in that the head of a screw and a tip of the screwdriver engaging the screw are often deformed or even damaged when an excessive force is applied. However, certain conventional screwdrivers are provided with two contact surfaces to which the handle and the blade are fastened. When the screwdriver is at work to tighten a screw, the center of the blade serves as a pivot such that the handle and the blade are capable of turning in relation to each other at the time when the applied torsional moment is greater than the pre-set torsional moment. The pre-set torsional moment is confined by the grade of a spring which urges the contact surfaces. The precision of the pre-set torsional moment is often undermined by the wear of the contact surfaces and the fatigue of the spring.

SUMMARY OF THE INVENTION

The primary objective of the present invention is to provide an improved screwdriver free from the drawbacks of the conventional screwdrivers described above.

In keeping with the principle of the present invention, the foregoing objective of the present invention is attained by a screwdriver consisting of a handle, a magnetic member, a shank, and an adjusting device. The handle is provided with an axial hole in which the magnetic member is disposed. The shank is pivotally located in the axial hole of the handle such that the shank is fastened at one end thereof with a blade, and a second end of the shank is in mutual attraction with the magnetic member. The magnitude of the mutual attraction between the shank and the magnetic member is adjusted by the adjusting device. The shank and the handle are capable of turning in relation to each other when the applied torsional moment is greater than the pre-set torsional moment.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
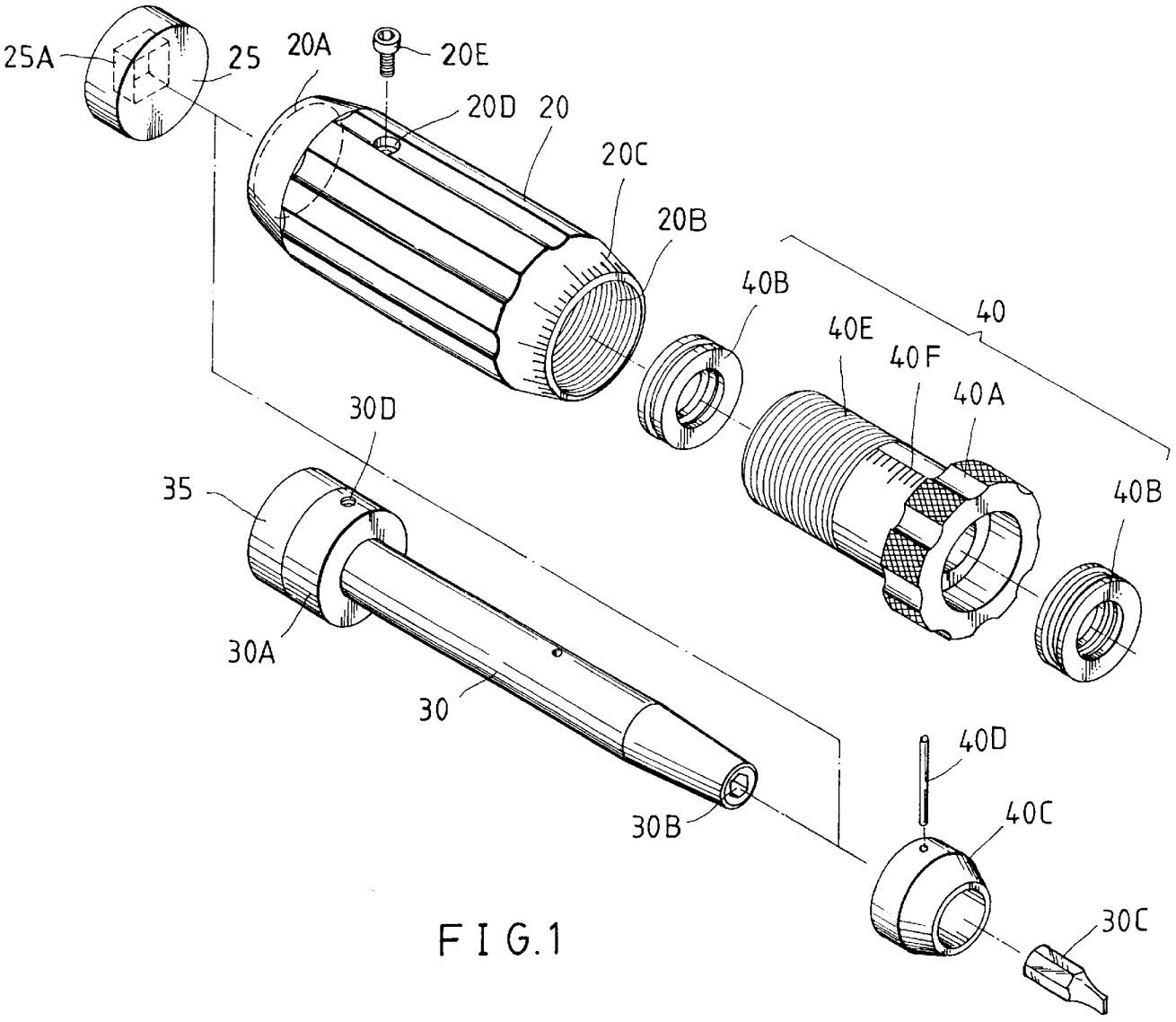
FIG. 1 shows an exploded view of a first preferred embodiment of the present invention.
Figure 2:
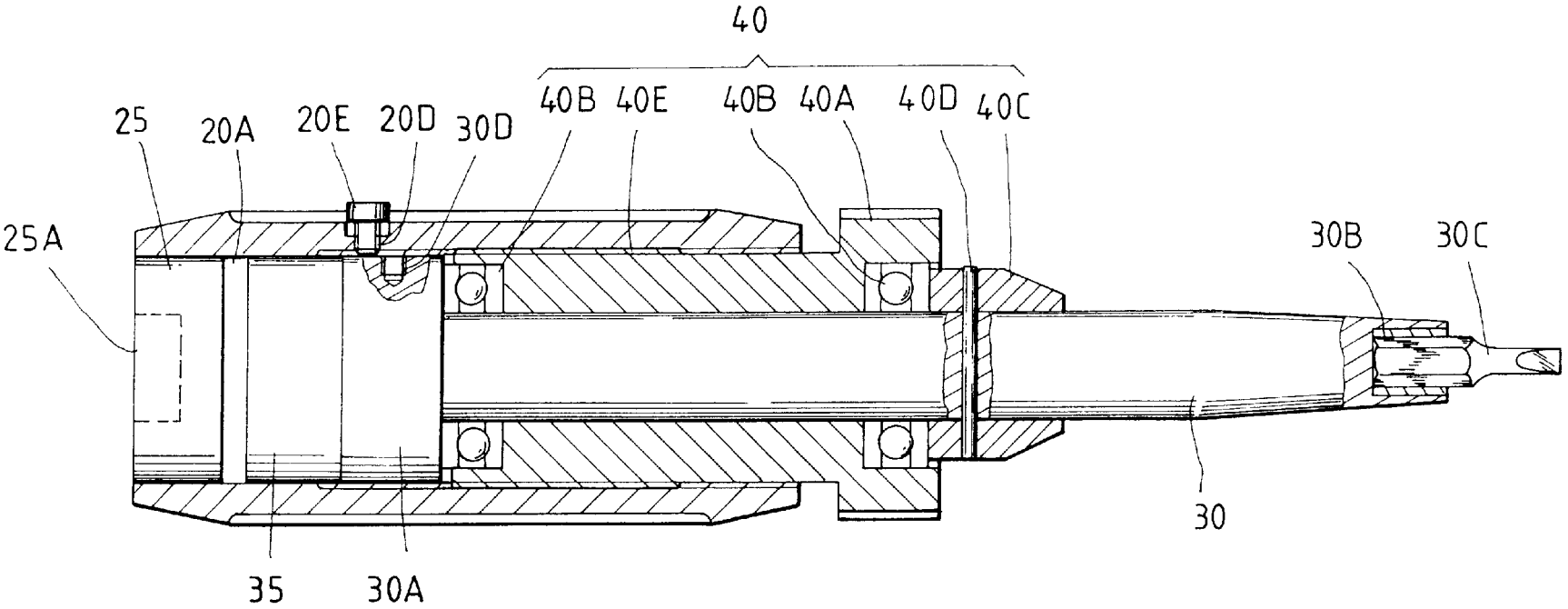
FIG. 2 shows a longitudinal sectional view of the first preferred embodiment of the present invention in combination.

As shown in FIGS. 1 and 2, a screwdriver embodied in the present invention is composed of a handle 20, a first magnetic member 25, a shank 30, a second magnetic member 35, and an adjusting device 40.

The handle 20 is provided with an axial through hole 20A having a threaded portion 20B, and is provided in the outer wall of one end thereof with a scale 20C.

The first magnetic member 25 is fixed in the axial through hole 20A and is provided at one end thereof with a rectangular connection hole 25A engageable with a connection head of the power tool.

The shank 30 is provided at a first end thereof with a protuberance 30A and at a second end thereof with a slot 30B for accommodating a blade 30C.

The second magnetic member 35 is fastened with the protuberance 30A.

The adjusting device 40 consists of a tubular member 40A, two bearings 40B, a ring 40C, and a fastening pin 40D. The tubular member 40A is provided with an outer threaded portion 40E and a graduated rule 40F. The bearings 40B are engaged with both ends of the tubular member 40A.

In combination, the shank 30 is located in the tubular member 40A such that the protuberance 30A is retained by the first bearing 40B. The ring 40C is fitted over the shank 30 such that the ring 40C is in contact with the second bearing 40B. The ring 40C is secured to shank 30 by the fastening pin 40D.

A shown in FIG. 2, the tubular member 40A is disposed in the axial through hole 20A. The first magnetic member 25 and the second magnetic member 35 are adjusted such that they are in contact with each other or are separated from each other at a distance, so as to set up the magnitude of their attractive force. The friction force between the threaded portion 40E and the threaded portion 20B is greater than that between the shank 30 and the tubular member 40A. The shank 30 is supported by the bearings 40B. The friction of the shank 30 is relatively small in relation to the rotation of the tubular member 40A. Whenever the screwdriver is exerted on by a torsional moment greater than a pre-set torsional moment, the shank 30 is caused to turn in relation to the tubular member 40A, or the handle 20. The pre-set torsional moment is determined by the distance between the first magnetic member 25 and the second magnetic member 35, as indicated by the graduated rule 40F and the scale 20C. The two magnetic members 25 and 35 may be all made of a magnet. Alternatively, one of the two magnetic members 25 and 35 may be made of a metal material capable of being attracted by the magnet. As a result, the scope of the pre-set torsional moment can be set up feasibly. The screwdriver of the present invention can be used in conjunction with a power tool which can be connected with the connection hole 25A of the first magnetic member 25.

The handle 20 is further provided with a first threaded hole 20D in communication with the axial through hole 20A. The threaded hole 20D is engaged with a first locating screw 20E which is in turn engaged with a locating threaded hole 30D of the shank 30, thereby fastening the handle 20 with the shank 30 such that the shank 30 can not be turned relative to the handle 20, and that the pre-set torsional moment can not be set. In the event that the pre-set torsional moment is called for, the first locating screw 20E is turned to disengage the locating threaded hole 30D.

Figure 3:
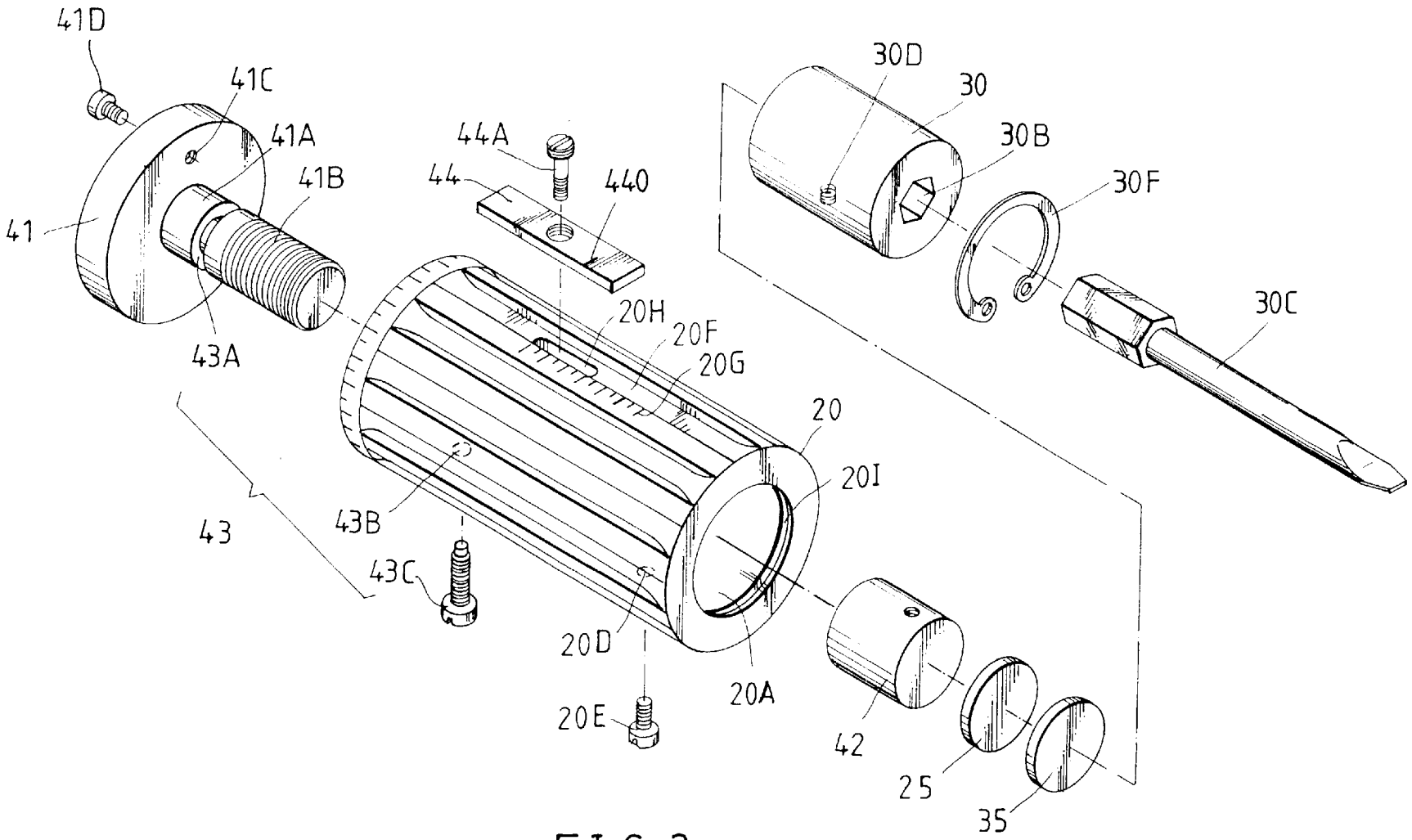
FIG. 3 shows an exploded view of a second preferred embodiment of the present invention.
Figure 4:
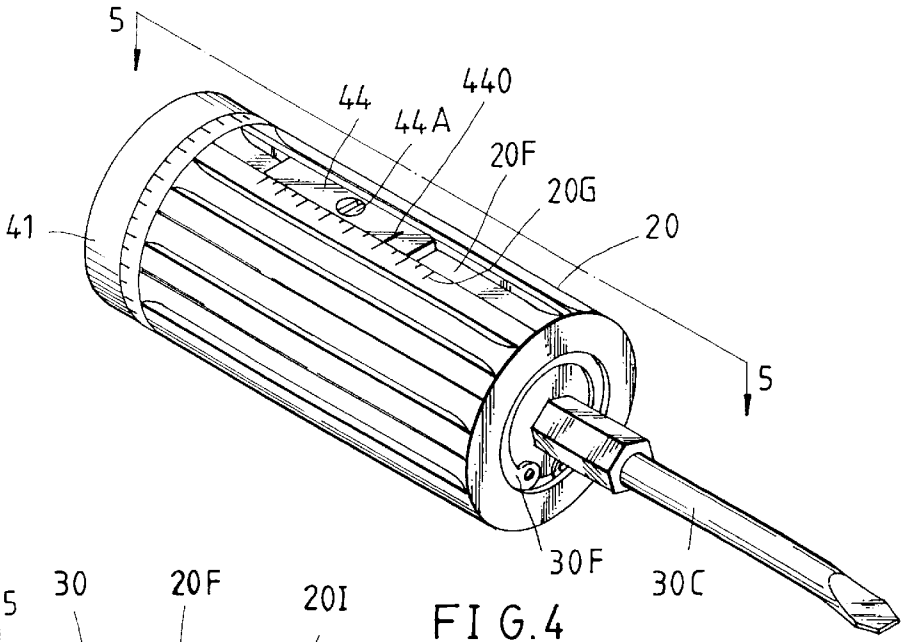
FIG. 4 shows a perspective view of the second preferred embodiment of the present invention in combination.
Figure 5:
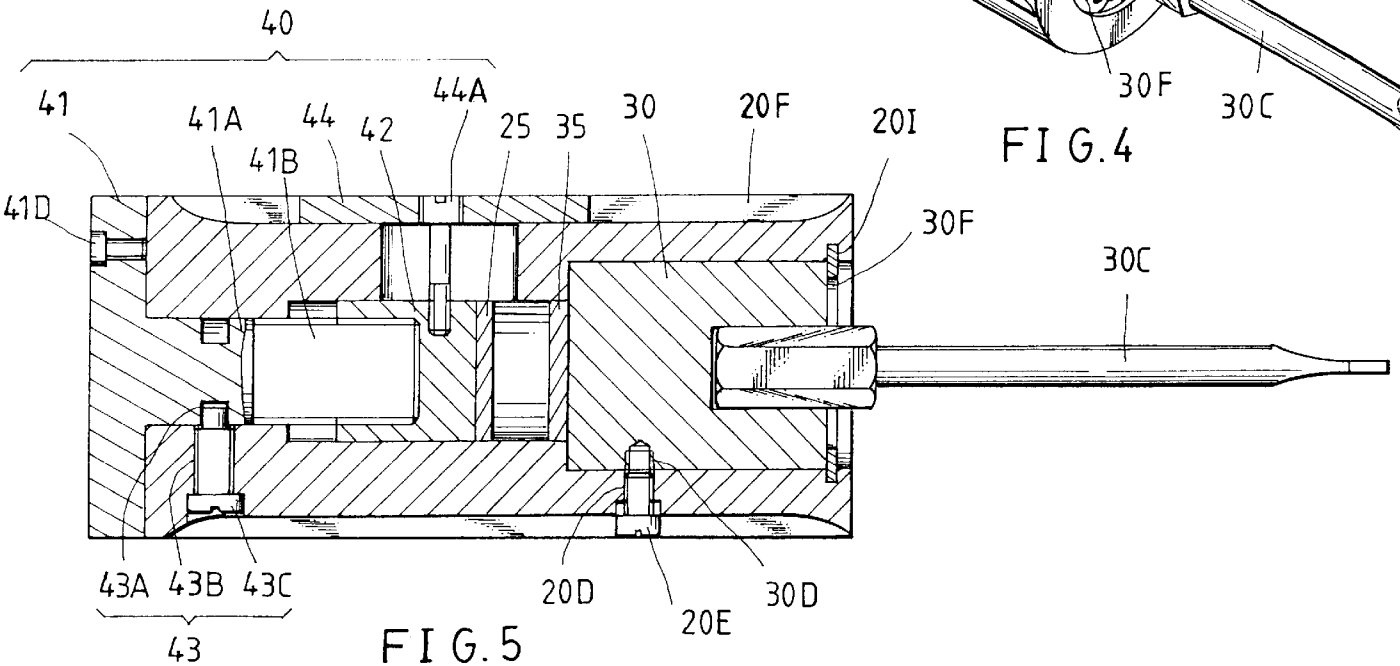
FIG. 5 shows a sectional view of a portion taken along the direction indicated by a line 5—5 as shown in FIG. 4.

As shown in FIGS. 3, 4 and 5, the second preferred embodiment of the present invention is different from the first preferred embodiment in that the former has the handle 20 which is provided in the outer periphery thereof with a recessed portion 20F of a length and extending along the direction of the longitudinal axis of the handle 20. The recessed portion 20F is provided along an edge thereof with a graduated scale 20G and is further provided therein with a slot 20H in communication with the axial hole 20A which is provided with a retaining slot 20I. In addition, the shank 30 is fastened at one end thereof with the second magnetic member 35 such that the shank 30 is engaged at a second end thereof with a C-shaped retainer 30F which is retained in the retaining slot 20I. As a result, the shank 30 is capable of turning relative to the axial hole 20A such that the shank 30 is prevented from displacing along the direction of the longitudinal axis of the axial hole 20A, as shown in FIG. 5. Moreover, the second preferred embodiment has the adjusting device 40 consisting of an adjustment knob 41 with a rotary shaft 41A which is rotatably received in the axial hole 20A. The rotary shaft 41A is provided with a threaded portion 41B, which is engaged with one end of a columnar nut 42 received in the axial hole 20A. The nut 42 is fastened at another end thereof with the first magnetic member 25. The axial displacement of the adjustment knob 41 is prevented by a retaining mechanism 43 consisting of a locating slot 43A extending along the rotary shaft 41A, a second threaded hole 43B located in the handle 20 and communicating with the axial hole 20A, and a second locating screw 43C which is engaged with the second threaded hole 43B. When the adjustment knob 41 is turned, the adjustment knob 41 is retained by the second locating screw 43C and is therefore unable to displace in the direction of the longitudinal axis of the axial hole 20A. A slide block 44 is provided with a base line 440 on the outer surface. The slide block 44 is slidably disposed in the recessed portion 20F such that the slide block 44 is fastened with the columnar nut 42 by a connection threaded rod 44A which is put through the slot 20H of the recessed portion 20F. When the adjustment knob 41 is turned, it idles such that the columnar nut 42 is confined by the slide block 44 to displace along the direction of the longitudinal axis of the rotary shaft 41A to change the depth in which it is engaged with the threaded portion 41B, so as to adjust the distance between the first and the second magnetic members 25 and 35. As a result, the pre-set torsional moment is set up.

The adjustment knob 41 is provided with a third threaded hole 41C, which is engaged with a third locating screw 41D having an end surface capable of contacting the top of the handle 20, as shown in FIG. 5, for locating the adjustment knob 41 after the desired distance between the first magnetic member 25 and the second magnetic member 35 has been set.

Figure 6:
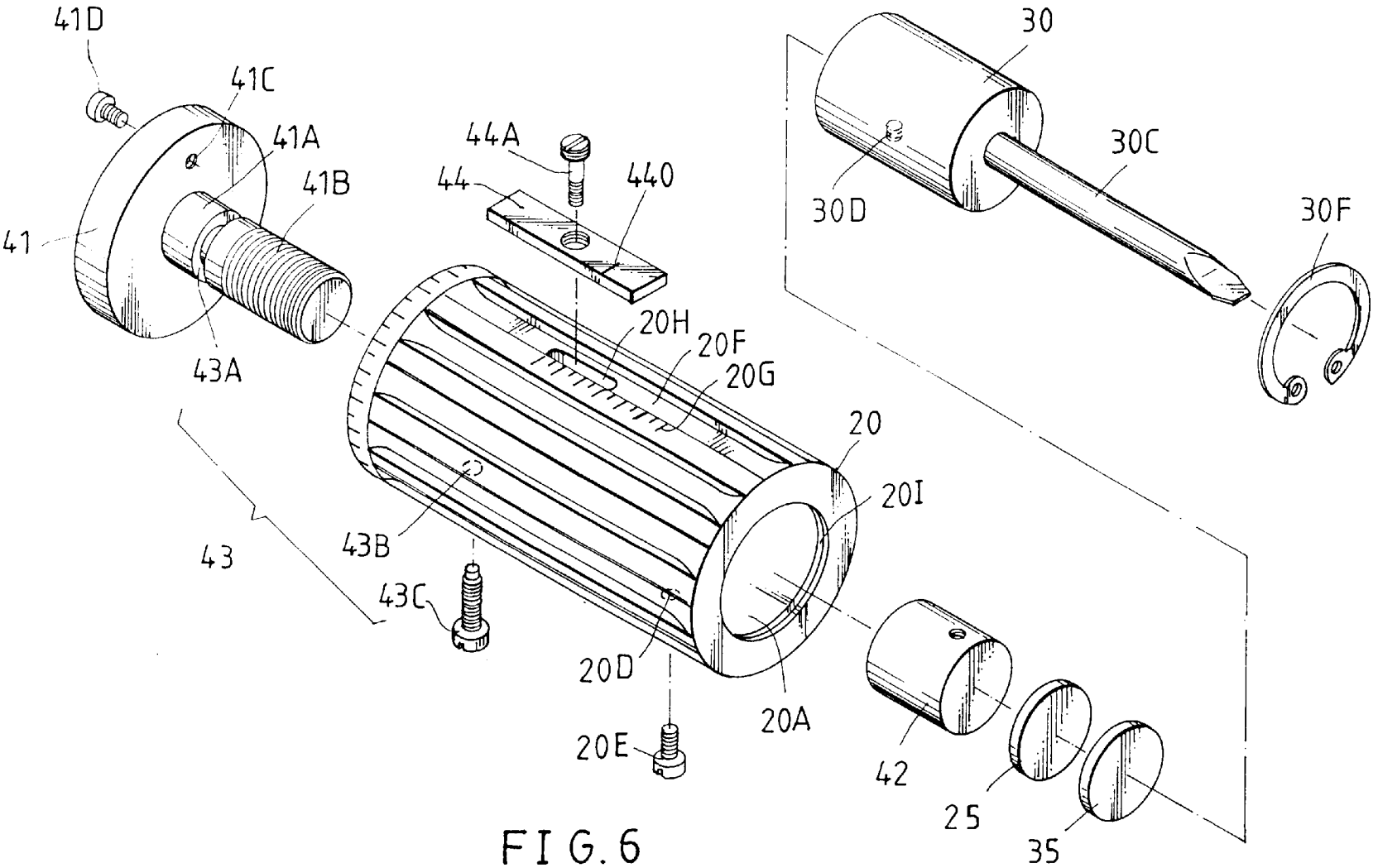
FIG. 6 shows an exploded view of a third preferred embodiment of the present invention.

As shown in FIG. 6, the third preferred embodiment is different from the second preferred embodiment in that the former has a shank 30 and a blade 30C which is made integrally with the shank 30.

Figure 7:
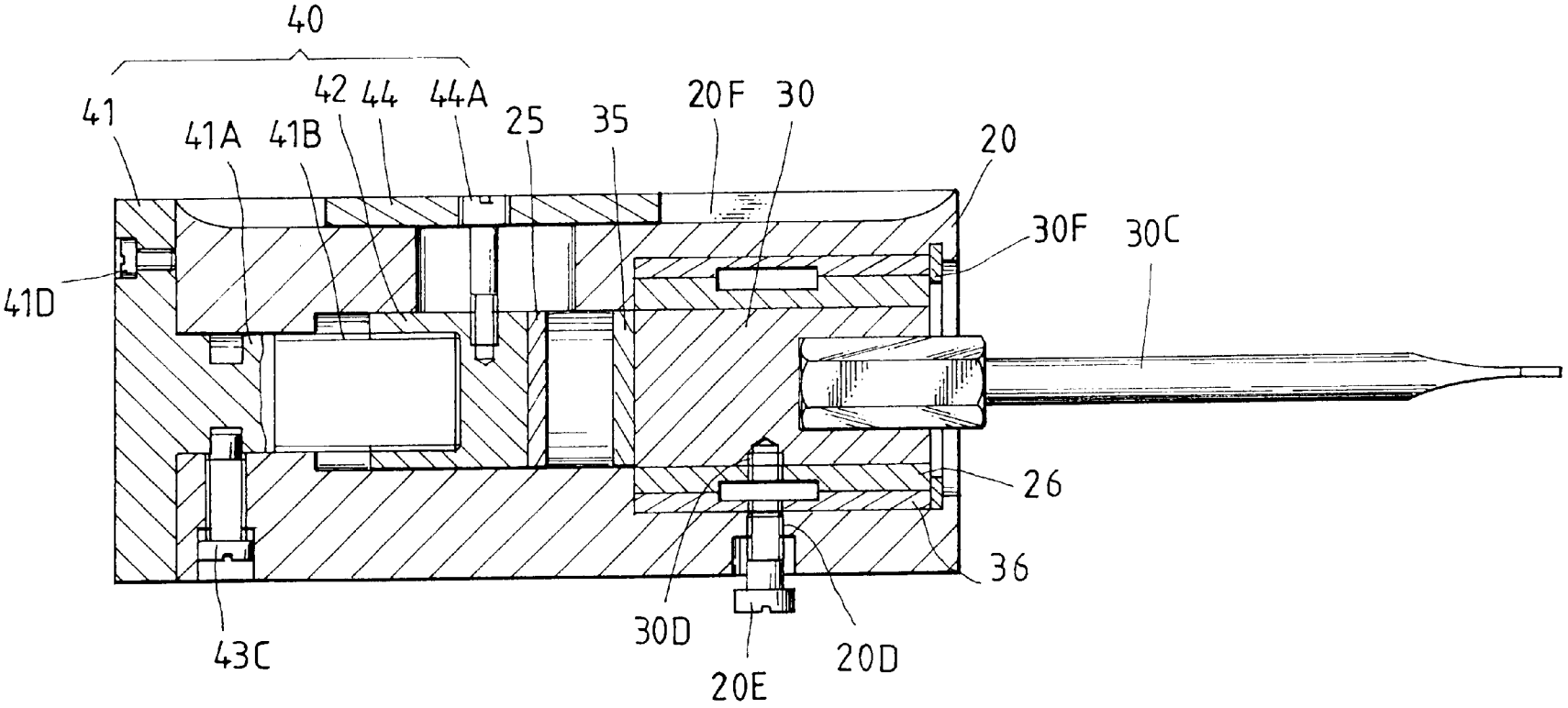
FIG. 7 shows a longitudinal sectional view of a fourth preferred embodiment of the present invention.

As shown in FIG. 7, the fourth preferred embodiment is different from the second preferred embodiment in that the former has a shank 30 which is provided in the outer periphery thereof with a third magnetic member 26, and that the former has an axial hole 20A which is provided with a fourth magnetic member 36 corresponding in location to the third magnetic member 26.

Figure 8:
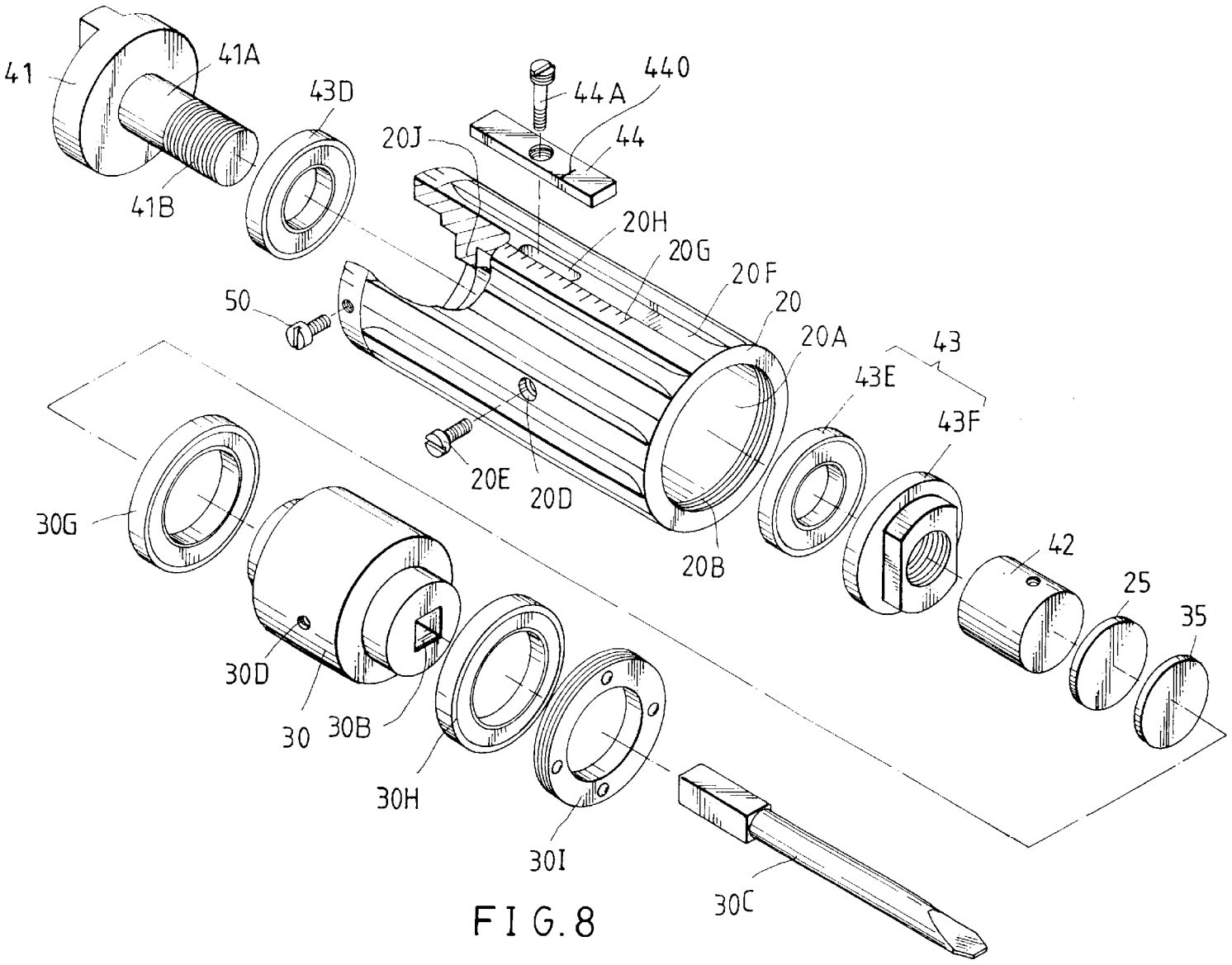
FIG. 8 shows an exploded view of a fifth preferred embodiment of the present invention.

As shown in FIG. 8, the fifth preferred embodiment is different from the second preferred embodiment in that the former has a retaining mechanism 43 which consists of the component parts described hereinafter.

A first bearing 43D and a second bearing 43E are disposed in the axial hole 20A such that they are located at two opposite sides of a partition 20J for mounting the rotary shaft 41A of the adjustment knob 41.

A fastening nut 43F is engaged with the threaded portion 41B of the rotary shaft 41A such that the fastening nut 43F urges the second bearing 43E, and that the adjustment knob 41 is prevented from displacing along the direction of the longitudinal axis of the axial hole 20A. The axial hole 20A is further provided with a third bearing 30G and a fourth bearing 30H, which are engaged with both ends of the shank 30. A circular screw 30I is engaged with one end of the shank 30 such that the screw 30I is in contact with the fourth bearing 30H. As a result, the shank 30 is prevented from displacing along the direction of the longitudinal axis of the axial hole 20A. A fourth locating screw 50 is engaged with the handle 20 such that the screw 50 is in contact with the adjustment knob 41, which is so located to prevent the set distance between the first magnetic member 25 and the second magnetic member 35 from being changed inadvertently.

Figure 9:
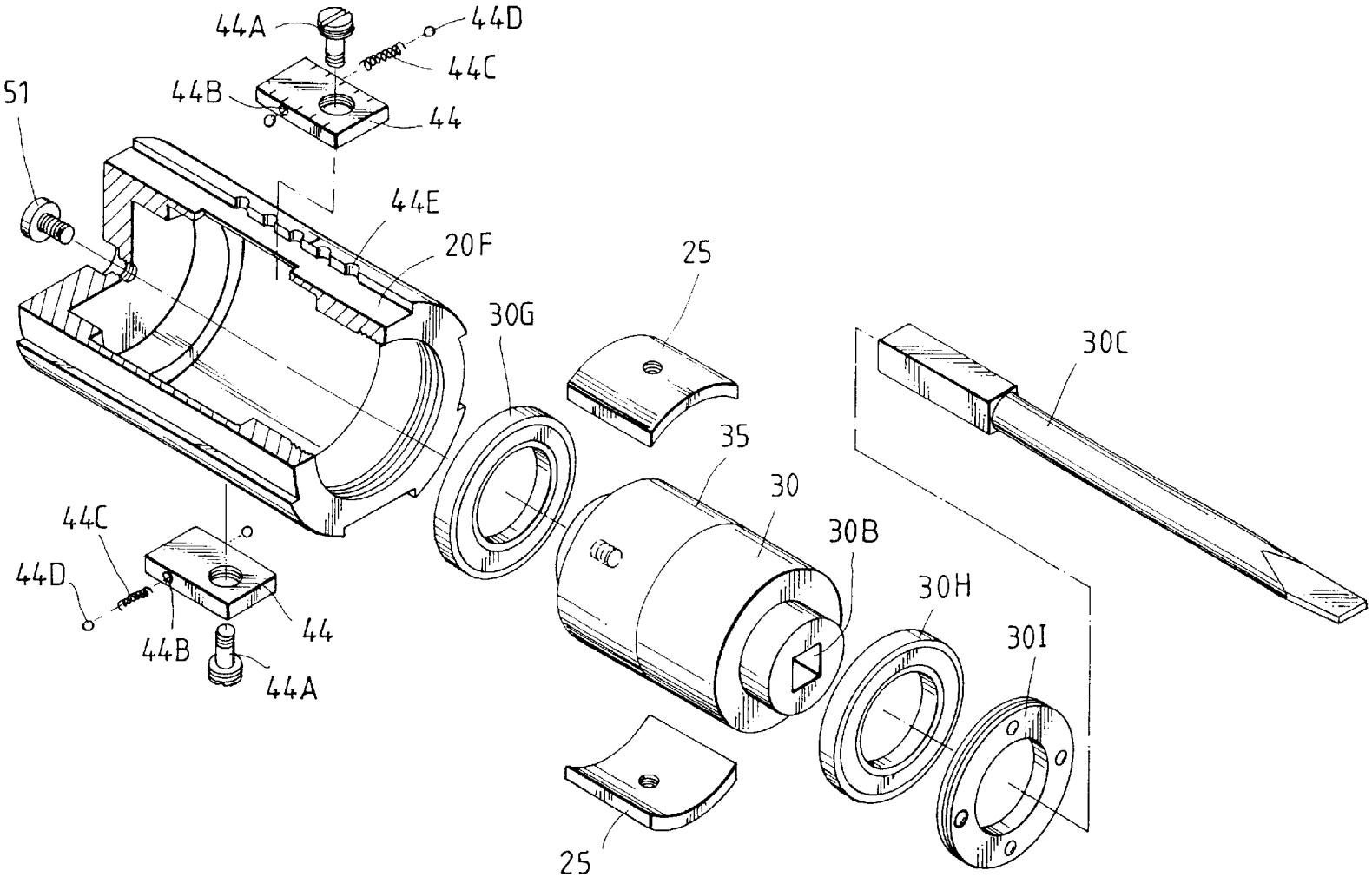
FIG. 9 shows an exploded view of a sixth preferred embodiment of the present invention.
Figure 10:
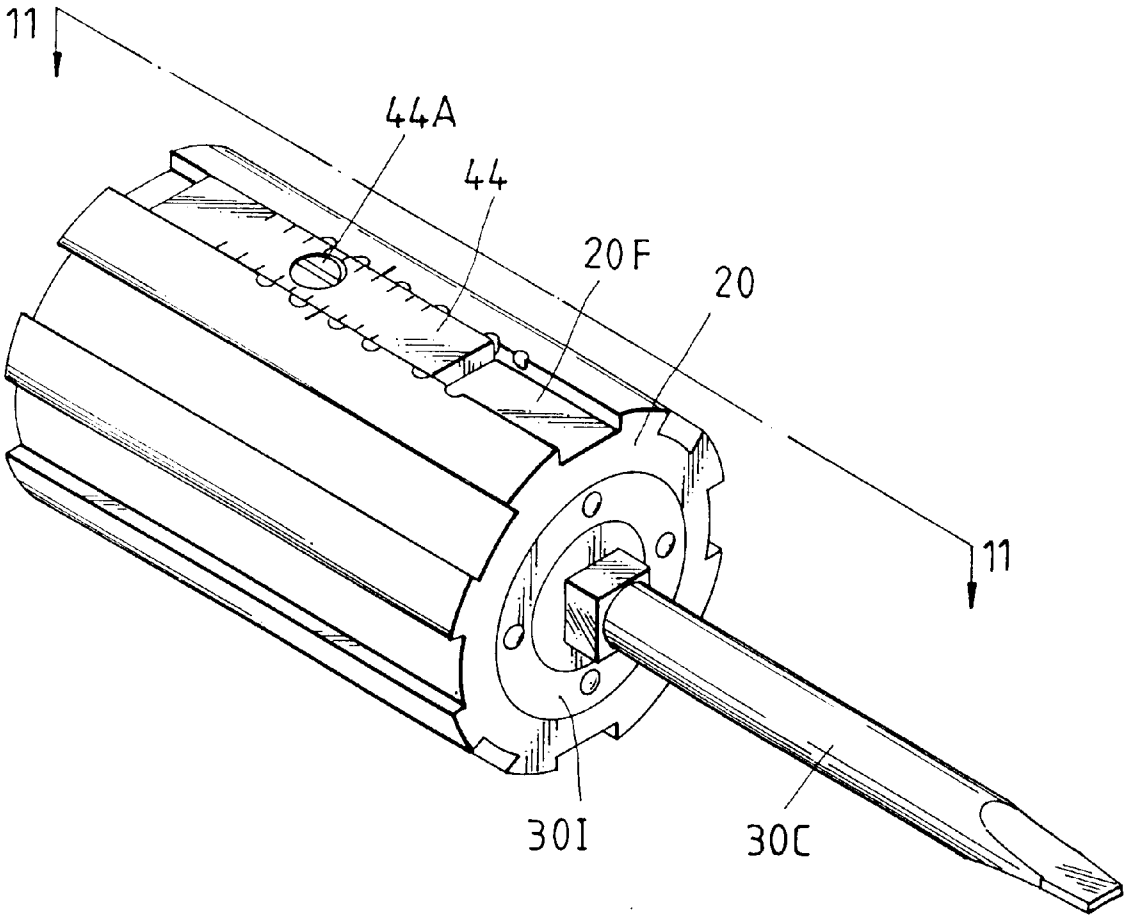
FIG. 10 shows a perspective view of the sixth preferred embodiment of the present invention.
Figure 11:
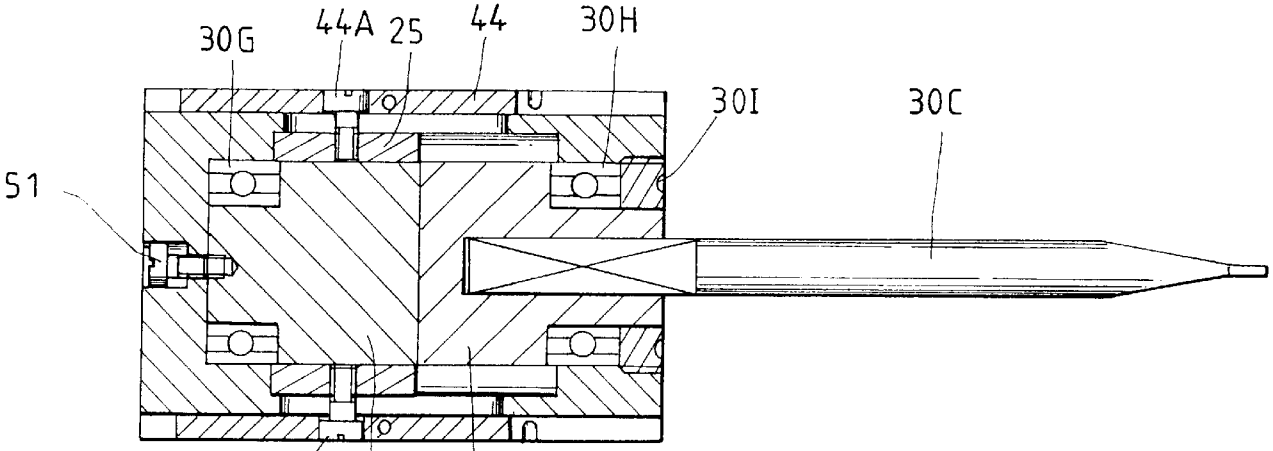
FIG. 11 shows a sectional view taken along a line 11—11 as shown in FIG. 10.

As shown in FIGS. 9–11, the sixth preferred embodiment is different from the previous embodiments in that the former has a first magnetic member 25 which is disposed in the periphery of the second magnetic member 35 and is connected with a slide block 44 by the connection threaded rod 44A. The slide block 44 is provided with a through hole 44B in which a spring 44C is located. The spring 44C is provided respectively at both ends thereof with a steel ball 44D which is retained in the locating slot 44E of the recessed portion 20F. When the slide block 44 is caused to slide in the recessed portion 20F, the first magnetic member 25 is actuated to slide along the direction of the longitudinal axis of the shank 30, thereby resulting in a change in the attraction areas of the first magnetic member 25 and the second magnetic member 35. A fifth locating screw 51 is engaged with the handle 20 and the second magnetic member 35 for preventing the shank 30 from turning in relation to the handle 20.

Figure 12:
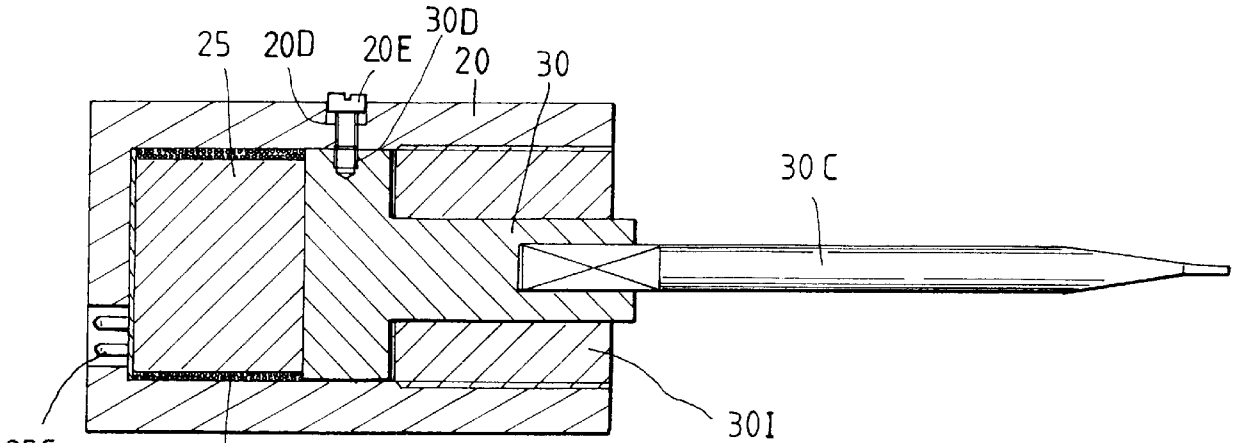
FIG. 12 shows a longitudinal sectional view of a seventh preferred embodiment of the present invention.

As shown in FIG. 12, the seventh preferred embodiment consists of a shank 30 made of a magnetic metal material and provided with a coil 25B fitted thereover such that the coil 25B is connected with an electrical plug 25C located in the handle 20. The electrical plug 25C is connected with a magnetic force charging rectifier (not shown in the drawing) such that the magnetic field intensity of the first magnetic member 25 can be properly adjusted in accordance with the need of the pre-set torsional moment of the screwdriver. After being charged by the recifier, the first magnetic member 25 becomes a permanent magnet. The screwdriver can be then disconnected with the rectifier.

What is claimed is:

1. A screwdriver comprising:

a handle provided with an axial hole;

a first magnetic member fixed in said axial hole of said handle;

a shank rotatable disposed in said axial hole and provided at a first end thereof with a blade fastened therewith, said shank having a second end attractive to said first magnetic member, said shank capable of turning in relation to said handle at such time when the screwdriver is exerted on by a torsional moment greater than a pre-set torsional moment of the screwdriver; and an adjusting device for adjusting the magnitude of attractive force between said first magnetic member and said second end of said shank, so as to determine said pre-set torsional moment of the screwdriver;

wherein said second end of said shank is provided with a second magnetic member fastened therewith; and wherein either said first magnetic member or said second magnetic member is a magnet;

wherein said adjusting device comprises:

a tubular member provided in an outer periphery thereof with a threaded portion which is engaged with said axial hole of said handle a first end of said tubular member being in contact with said second magnetic member; and a ring fastened with said shank such that said ring is in contact with a second end of said tubular member;

said first magnetic member and said second magnetic member being spaced apart by a distance which can be adjusted by adjusting a depth in which said tubular member is engaged in said axial hole.

2. A screwdriver comprising:

a handle provided with an axial hole;

a first magnetic member fixed in said axial hole of said handle;

a shank rotatably disposed in said axial hole and provided at a first end thereof with a blade fastened therewith, said shank having a second end attractive to said first magnetic member, said shank capable of turning in relation to said handle at such time when the screwdriver is exerted on by a torsional moment greater than a pre-set torsional moment of the screwdriver; and an adjusting device for adjusting the magnitude of attractive force between said first magnetic member and said second end of said shank, so as to determine said pre-set torsional moment of the screwdriver;

wherein said handle is further provided with a first threaded hole in communication with said axial hole; wherein said shank is provided with a locating threaded hole; and wherein said shank and said handle are fastened by a first locating screw which is engaged with said first threaded hole of said handle and said locating threaded hole of said shank.

3. The screwdriver as defined in claim 2, wherein said shank and said blade are made integrally.

4. The screwdriver as defined in claim 2, wherein said second end of said shank is provided with a second magnetic member fastened therewith; and wherein either said first magnetic member or said second magnetic member is a magnet.

5. The screwdriver as defined in claim 4, wherein said adjusting device comprises:

a tubular member provided in an outer periphery thereof with a threaded portion which is engaged with said axial hole of said handle such that one end of said tubular member is in contact with one end of said second magnetic member; and a ring fastened with said shank such that said ring is in contact with another end of said tubular member;

said first magnetic member and said second magnetic member being separated from each other by a distance which can be adjusted by adjusting a depth in which said tubular member is engaged with said axial hole.

6. The screwdriver as defined in claim 1, wherein said ring is located by a pin.

7. The screwdriver as defined in claim 1, wherein said tubular member is provided in the outer periphery thereof with a graduated rule; and wherein said handle is provided in an outer periphery thereof with a scale opposite to said graduated rule for providing a reading as to a torsional moment exerting on the screwdriver.

8. A screwdriver comprising:

a handle provided with an axial hole;

a first magnetic member disposed in said axial hole of said handle;

a shank rotatable disposed in said axial hole and provided at a first end thereof with a blade fastened therewith, said shank having a second end attractive to said first magnetic member, said shank capable of turning in relation to said handle at such time when the screwdriver is exerted on by a torsional moment greater than a pre-set torsional moment of the screwdriver; and an adjusting device for adjusting the magnitude of attractive force between said first magnetic member and said a second end of said shank, so as to determine said pre-set torsional moment of the screwdriver;

wherein said second end of said shank is provided with a second magnetic member fastened therewith; and wherein either said first magnetic member or said second magnetic member is a magnet;

wherein said handle is provided in an outer periphery thereof with a recessed portion of a length and extending along the direction of a longitudinal axis of said handle, said recessed portion provided with a slot in communication with said axial hole of said handle; wherein said adjusting device comprises:

an adjusting knob having a rotary shaft rotatably located in said axial hole and provided with a threaded portion;

a columnar nut located in said axial hole such that a first end of said columnar nut is engaged with said threaded portion of said adjusting knob, a second end of said columnar nut being fastened with said first magnetic member;

a retaining mechanism located in said handle and connected with said adjusting knob for preventing said adjusting knob from displacing along said axial hole;

a slide block slidably disposed in said recessed portion; and a connection threaded rod fastening said slide block and said columnar nut via said slot of said recessed portion;

said first magnetic member and said second magnetic member being spaced apart a distance adjustable by said columnar nut which is actuated by said adjusting knob to displace along said axial hole.

9. The screwdriver as defined in claim 8, wherein said recessed portion is provided with a graduated rule extending along the direction of a longitudinal axis of said handle.

10. The screwdriver as defined in claim 8, wherein said retaining mechanism comprising:

a locating slot located in said rotary shaft;

a second threaded hole located in said handle and in communication with said axial hole;

a second locating screw engaged with said first threaded hole such that one end of said second locating screw is received in said locating slot;

said adjusting knob being prevented by said first locating screw from displacing along said axial hole.

11. The screwdriver as defined in claim 8, wherein said retaining mechanism comprises:

at least one bearing located in said axial hole and engaged with said rotary shaft; and a fastening nut engaged with said threaded portion of said rotary shaft such that said fastening nut urges said bearing.

12. The screwdriver as defined in claim 8, wherein said adjusting knob is provided with a third threaded hole engaged with a third locating screw for locating said adjusting knob.

13. The screwdriver as defined in claim 8, wherein said axial hole is provided with a retaining slot, and a C-shaped retainer retained in said retaining slot such that said C-shaped retainer is capable of retaining one end of said shank so as to prevent said shank from displacing along said axial hole.

14. The screwdriver as defined in claim 8, wherein said axial hole is provided with two bearings fastened with both ends of said shank, and a circular screw engaged with one end of said shank to prevent said shank from displacing along said axial hole.

15. A screwdriver comprising:

a handle provided with an axial hole;

a first magnetic member fixed in said axial hole of said handle;

a shank rotatable disposed in said axial hole and provided at a first end thereof with a blade fastened therewith, said shank having a second end attractive to said first magnetic member, said shank capable of turning in relation to said handle at such time when the screwdriver is exerted on by a torsional moment greater than a pre-set torsional moment of the screwdriver; and an adjusting device for adjusting the magnitude of attractive force between said first magnetic member and said a second end of said shank, so as to determine said pre-set torsional moment of the screwdriver;

wherein said second end of said shank is provided with a second magnetic member fastened therewith; and wherein either said first magnetic member or said second magnetic member is a magnet;

wherein said shank is provided with a third magnetic member; and wherein said axial hole is provided with a fourth magnetic member corresponding in location to said third magnetic member.

16. The screwdriver as defined in claim 15, wherein said third magnetic member or said fourth magnetic member is a magnet.

17. A screwdriver comprising.

a handle provided with an axial hole;

a first magnetic member fixed in said axial hole of said handle;

a shank rotatable disposed in said axial hole and provided at a first end thereof with a blade fastened therewith, said shank having a second end attractive to said first magnetic member, said shank capable of turning in relation to said handle at such time when the screwdriver is exerted on by a torsional moment greater than a pre-set torsional moment of the screwdriver; and an adjusting device for adjusting the magnitude of attractive force between said first magnetic member and said a second end of said shank, so as to determine said pre-set torsional moment of the screwdriver;

wherein said second end of said shank is provided with a second magnetic member fastened therewith; and wherein either said first magnetic member or said second magnetic member is a magnet;

wherein said first magnetic member is fitted over said second magnetic member; and wherein said adjusting device comprises:

at least one recessed portion located in periphery of said handle and provided with a slot in communication with said axial hole;

a slide block slidably located in said recessed portion such that said slide block is capable of actuating said first magnetic member to slide along said second magnetic member and along the direction of a longitudinal axis of said shank, so as to bring about a change in attraction areas of said first magnetic member and said second magnetic member; and a connection threaded rod for fastening said slide block with said first magnetic member via said slot of said recessed portion.

18. The screwdriver as defined in claim 17, wherein said recessed portion is provided respectively along two longitudinal sides thereof with a plurality of locating slots; and wherein said slide block is provided in one side thereof with a through hole for locating a spring which is provided respectively at both ends thereof with a steel ball fastened therewith such that said steel ball is retained in said locating slot.

19. The screwdriver as defined in claim 1, wherein said first magnetic member is a permanent magnet and is provided with a coil fitted thereover; and wherein said adjusting device is a magnetic rectifier connected electrically with said coil for adjusting the magnetic field intensity of said first magnetic member.

20. The screwdriver as defined in claim 1, wherein said first magnetic member is further provided at one end thereof with a rectangular connection hole.

* * * * *